US009284763B2

(12) United States Patent
Karcher

(10) Patent No.: US 9,284,763 B2
(45) Date of Patent: Mar. 15, 2016

(54) DOOR STOP

(71) Applicant: Jeffrey Lawrence Karcher, Portland, OR (US)

(72) Inventor: Jeffrey Lawrence Karcher, Portland, OR (US)

( * ) Notice: Subject to any disclaimer, the term of this patent is extended or adjusted under 35 U.S.C. 154(b) by 0 days.

(21) Appl. No.: 14/210,019

(22) Filed: Mar. 13, 2014

(65) Prior Publication Data

US 2014/0259523 A1 Sep. 18, 2014

Related U.S. Application Data

(60) Provisional application No. 61/799,913, filed on Mar. 15, 2013, provisional application No. 61/820,076, filed on May 6, 2013.

(51) Int. Cl.

| | |
|---|---|
| ***E05D 3/02*** | (2006.01) |
| ***E05D 11/00*** | (2006.01) |
| ***E05D 11/06*** | (2006.01) |
| ***E05F 5/06*** | (2006.01) |

(52) U.S. Cl.

CPC ..... *E05D 11/00* (2013.01); *E05D 11/06* (2013.01); *E05F 5/06* (2013.01); *E05Y 2800/692* (2013.01); *Y10T 16/61* (2015.01)

(58) Field of Classification Search

CPC ..... E05D 11/00; E05D 11/06; E05D 3/00; E05D 3/02; E05D 7/00; E05D 7/0009; E05D 7/0045

USPC ..... 16/374, 375, 223, 319, 372, 377, 250, 16/251

See application file for complete search history.

(56) References Cited

U.S. PATENT DOCUMENTS

| | | | | | |
|---|---|---|---|---|---|
| 171,618 | A * | 12/1875 | House | 16/346 |
| 1,481,742 | A * | 1/1924 | Riley | 16/374 |
| 1,757,261 | A * | 5/1930 | Simmons | 16/82 |
| 2,504,635 | A * | 4/1950 | Bradley | 16/223 |
| 2,586,757 | A * | 2/1952 | Wummel et al. | 16/250 |
| 3,157,906 | A * | 11/1964 | Wolf | 16/50 |
| 3,651,540 | A * | 3/1972 | Rana | 16/251 |
| 4,040,142 | A * | 8/1977 | Ippolito | 16/251 |
| 4,070,727 | A * | 1/1978 | Kanou | 16/72 |
| 4,477,941 | A * | 10/1984 | Gregg | 16/289 |
| 4,684,158 | A * | 8/1987 | Miclot | 292/76 |
| 4,878,267 | A * | 11/1989 | Roach et al. | 16/250 |
| 5,664,822 | A * | 9/1997 | Rosenfield | 296/39.2 |
| 6,276,026 | B1 * | 8/2001 | Wille | 16/250 |
| 6,311,367 | B1 * | 11/2001 | Larsen | 16/375 |
| 8,505,168 | B1 * | 8/2013 | Chapman | 16/382 |
| 2013/0219665 | A1 * | 8/2013 | Apostoloff | 16/375 |

FOREIGN PATENT DOCUMENTS

| | | | | |
|---|---|---|---|---|
| DE | 3230369 | A1 * | 2/1984 | E05D 11/00 |

* cited by examiner

*Primary Examiner* — Emily Morgan

(74) *Attorney, Agent, or Firm* — Alleman Hall McCoy Russell & Tuttle LLP

(57) ABSTRACT

Various implementations of a hinge-mounted door stop are disclosed. In some implementations, the door stop is fashioned to be unobtrusive when installed on a door hinge assembly in order to reduce a possibility of being noticed in plain sight. Moreover, the door stop has a simple construction that allows quick and easy installation on a door hinge assembly relative to other configurations.

8 Claims, 12 Drawing Sheets

DOOR STOP

CROSS REFERENCE TO RELATED APPLICATIONS

This application claims priority to U.S. Provisional Patent Application Ser. No. 61/799,913, filed Mar. 15, 2013, and U.S. Provisional Patent Application Ser. No. 61/820,076, filed May 6, 2013, the disclosures of which are hereby incorporated by reference in their entirety and for all purposes.

BACKGROUND

Different types of door stops may be used to guide a position of a door. For example, some types of door stops may be employed to prevent an inward-opening door from swinging open to a point where the door's knob hits a wall located behind the open door. In one example, a door stop may be mounted at the bottom of an inner side of the door. The door stop may protrude outwardly from the inner side of the door far enough to prevent the door knob from hitting the wall when the door is fully open. Similarly, in another example, a door stop may be wall mounted and may protrude outwardly from the wall far enough to prevent the door knob from hitting the wall when the door is fully open. Since these types of door stops protrude outwardly from the door or wall, they may become obstructive when the door is closed. For example, these types of door stops may be struck when the door is closed and can be broken, loosened from their mounting position, or ripped from a mounting surface.

In another example, a door stop may be mounted to a hinge pin and may include two arms protruding outward to contact a door-side hinge and a frame-side hinge when the door is open to prevent the door from opening too far. This type of door stop may be less obstructive. However, all of the above described types of door stops may not prevent a door from opening too far if enough force is exerted on the door.

Furthermore, some types of door stops may be designed, with security in mind, to prevent a door from opening from a closed position. In one example, a security door stop may include a shaft that secures under a door knob and extends downward at an angle away from the door to the floor. The shaft may put tension on the door while in place to prevent the door from opening from a closed position. In another example, a security door stop may include a floor-mounted base plate and a removable top block. The base plate may be positioned on the floor just behind the closed door and the top block may be set in the base plate and may extend upward behind the door to prevent the door from opening. Like the other types of door stops described above, these security door stops may be obstructive when put in place to secure a door. For example, both of these types of security door stops may be tripping hazards. Moreover, all of the above described door stops may be quite noticeable in plain sight and may not blend in with the door. In other words, these door stops may not be ascetically pleasing to the eye.

DETAILED DESCRIPTION

The present description relates to a door stop for guiding a position of a door. More particularly, the present description relates to a hinge-mounted door stop that may be unobtrusive when installed. Furthermore, the door stop may have increased strength relative to a configuration that protrudes from a door or a wall, or that is mounted only to a hinge pin. In some embodiments, the door stop may reinforce a door hinge assembly in order to reduce a possibility of the door hinge assembly and/or the door being overcome or failing due to exertion against the door. In some embodiments, the door stop prevents a door from being opened from a closed position (e.g., zero degree opening). In some embodiments, the door stop may be fashioned to blend in with a door hinge assembly in order to reduce a possibility of being noticed in plain sight. Moreover, the door stop may have a simple construction, and may be quickly and easily installed on a door hinge assembly relative to other configurations.

Figure 1:
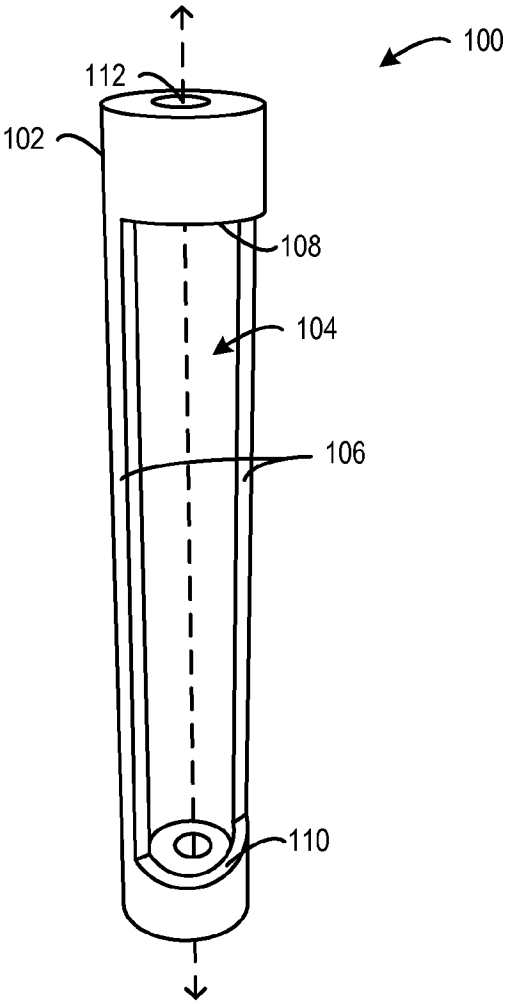
FIG. 1 shows a perspective view of a first example of a door stop.

FIG. 1 shows a perspective view of a door stop 100. The door stop 100 may include a body 102 that is cylindrical in shape. The body 102 may include a cavity 104 that is sized to contain a door hinge assembly. In particular, the cavity may be shaped to fit any suitable door hinge assembly. The cavity 104 may be partially enclosed within the body 102 by sidewalls 106. The portion of the cavity that is not enclosed by the sidewalls may allow for hinge plates of the door hinge assembly to protrude from the cavity and out from a side of the body. The sidewalls may restrict travel of the hinge plates to a designated range of angular rotation. In particular, a range of travel of the hinge plates may be dependent on a radial position of the sidewalls along a circumference of the cylindrical body. It is to be understood that the sidewalls may be positioned to provide any suitable range of hinge plate travel to guide a position of a door. In one example, the door stop may be configured to have any range between zero and ninety degrees. More preferably, the door stop may be configured to have any range between zero and sixty degrees. In one particular example, a door stop is configured to allow zero degrees of hinge plate travel. In this example, the door stop may be placed on a hinge of a door to maintain the door in a closed position and prevent the door from being opened. Various examples of doors stops having different ranges of radial hinge plate travel are discussed in further detail below with reference to FIGS. 5 and 6.

The body 102 may include an upper wall 108 and a lower wall 110. The upper wall and the lower wall may be spaced apart to allow the hinge plates to protrude from the body. The upper wall and lower wall may help secure the door stop to the door hinge assembly. In some embodiments, the cavity may extend upward beyond the upper wall and/or downward beyond the lower wall. In such embodiments, the cavity may be extended to accommodate knuckles that are collectively longer than the hinge plates.

The body 102 may include a hole 112 positioned at a radial center of the cylinder. The hole may be sized to accommodate a hinge pin that may align the knuckles of the door hinge assembly within in the cavity. By placing a hinge pin through the hole and further through the knuckles, the door hinge assembly may be coupled to the door stop. In the illustrated embodiment, the hole extends through an entire height of the body. Although, in some embodiments, the hole may extend from a side through only a portion of the body.

The door stop 100 may be made of any suitable material. Non-limiting examples of such material may include polypropylene, steel, poly-infused carbon fiber, copolymer polypropylene, homopolymer polypropylene, expanded polypropylene, neoprene-coated polypropylene, copper, and brass. Furthermore, the door stop 100 may have any suitable color or finish. Note that a thickness of the sidewalls 106 may be dependent on the type of material used to make the door stop in order to achieve a suitable strength threshold. Non-limiting examples of such colors/finishes may include polished brass, brass, nickel, polished nickel, oil-rubbed bronze, polished chrome, brushed nickel, oil-rubbed copper, and black paint. For example, the finish of the door stop may be matched with a finish of a door hinge in order for the door stop to blend in with the hinge assembly. The door stop 100 may be fashioned in any suitable manner. For example, the door stop 100 may be machined from a solid piece. In another example, the door stop 100 may be created using an extrusion process.

Figure 2:
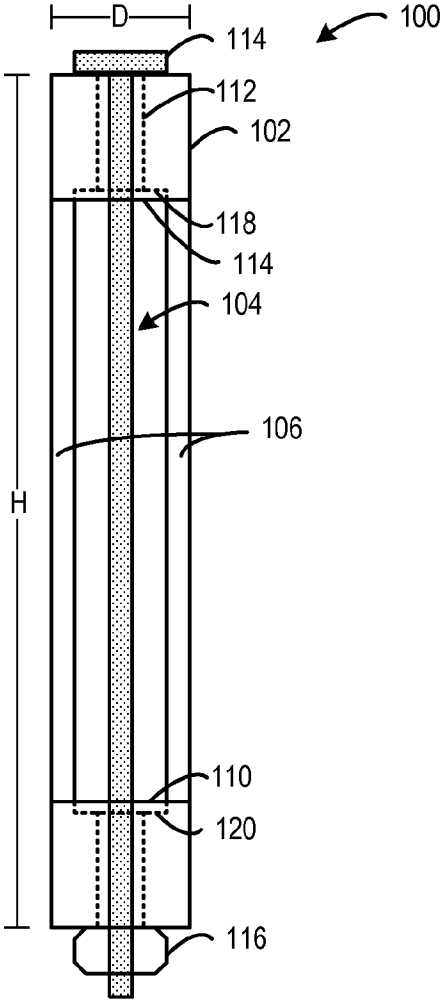
FIG. 2 shows a cross section view of the door stop of FIG. 1.

FIG. 2 shows a cross-section view of the door stop 100. The cylindrical body 102 has a height (H) and a diameter (D). The height and the diameter may be dependent on a size of a door hinge assembly on which the door stop is configured to be installed. A hinge pin 114 is shown installed in the hole 112. The hinge pin extends all the way through the door stop and protrudes beyond a bottom of the body. In some embodiments, the hinge pin may be threaded and may be secured in place in the door stop by a nut 116 or other fastener. In some embodiments, the hinge pin may only extend through a portion of the body. For example, the hinge pin may only extend down to the lower wall 110.

The cavity 104 may include a ceiling 118 and a floor 120. In some embodiments, the ceiling may be recessed above the upper wall and/or the floor may be recessed below the lower wall. Such recesses may help the knuckles of the door hinge assembly remain aligned when the hinge pin is not inserted through the door stop and the door hinge assembly.

In some embodiments, an opening between the sidewalls may be large enough to slide the knuckles through the opening and into the cavity, such as an opening in a door stop that allows a relatively large range of radial hinge plate travel (e.g., 90°). In some embodiments, the opening may be too narrow to slide the knuckles into the cavity, such as an opening in a door stop that allows a relatively small range of radial hinge plate travel (e.g. 0°). In such embodiments, the cavity may be extended through a bottom of the body and the lower wall and floor may be eliminated. Further, the door stop may be installed on the door hinge assembly, by sliding the body over the top of the knuckles while the hinge plates protrude through the narrow opening. In this case, since the floor is eliminated, the hinge pin may be preferably threaded and secured in place by a nut.

Figure 3:
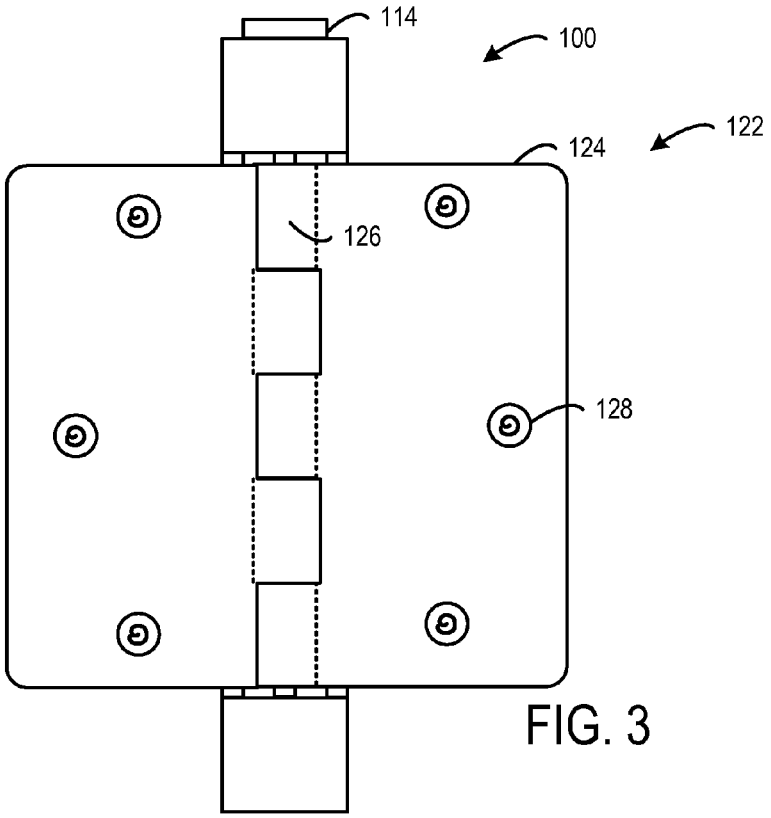
FIG. 3 shows a rear view of the door stop of FIG. 1 installed on a door hinge assembly.

FIG. 3 shows a rear view of the door stop 100 installed on a door hinge assembly 122. The door hinge assembly 122 may include hinge plates 124, knuckles 126, and screw holes 128. The hinge plates may be mounted to a door and frame via screws that are fastened through the screw holes. The knuckles of each hinge plate may be aligned and the hinge pin 114 may be passed through the hole in the door stop and through the knuckles to secure the door hinge assembly to the door stop. Note in the illustrated embodiment, the knuckles do not extend beyond the upper wall or the lower wall of the door stop. Furthermore, the opening in the cavity may be wide enough to accept the knuckles into the cavity.

Figure 4:
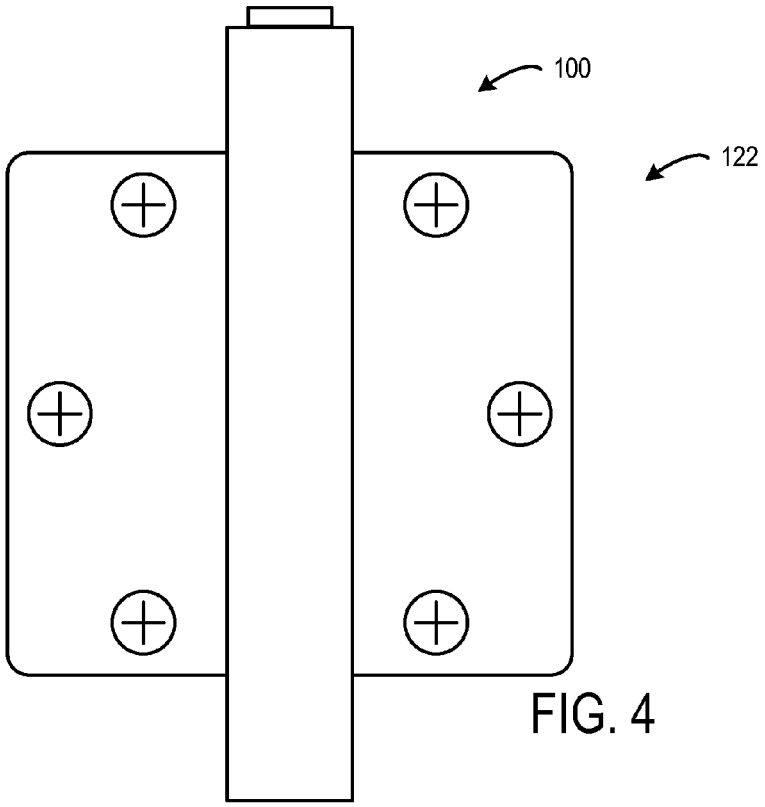
FIG. 4 shows a front view of the door stop of FIG. 1 installed on a door hinge assembly.

FIG. 4 shows a front view of the door stop 100 installed on the door hinge assembly 122. The door stop may contain the knuckles of the door hinge assembly. By containing the knuckles of the door hinge assembly, the door stop may provide added strength to the door hinge assembly to reduce a possibility of failure due to excessive force being applied to open the door (e.g., kicking in the door). In this way, the door stop may provide added security, in some cases.

Furthermore, the door stop may have a small form factor that may blend in with the shape of the door hinge assembly. By blending in with the door hinge assembly, there may be less of a possibility that the door stop may be identified and tampered with. Moreover, the door stop may have a pleasing aesthetic.

Figure 5:
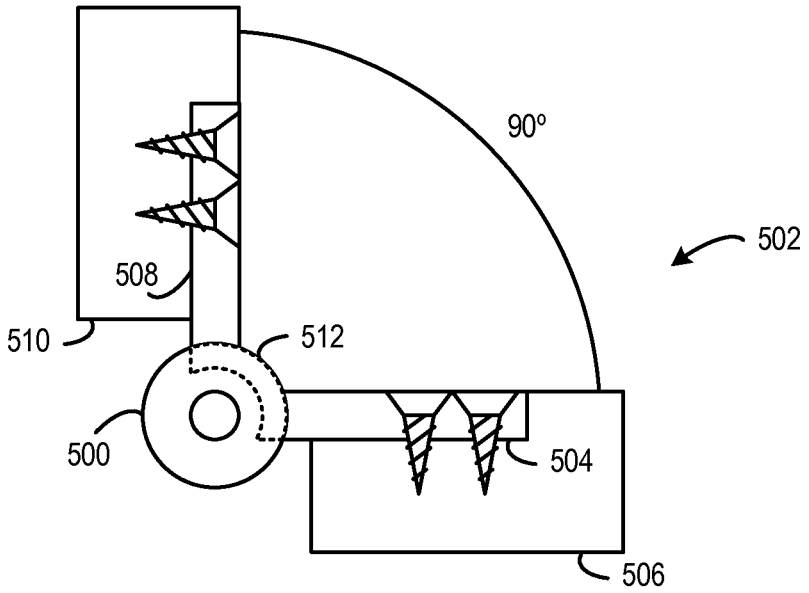
FIG. 5 shows a top view of a door stop configured with a designated range of radial hinge plate travel of ninety degrees.

FIG. 5 shows a top view of a door stop 500 configured with a designated range of radial hinge plate travel of ninety degrees. The door stop 500 may be installed on a door hinge assembly 502 that includes a frame-side hinge plate 504 that is mounted to a frame 506 and a door-side hinge plate 508 that is mounted to a door 510. The door stop 500 may form an opening 512 through which the hinge plates protrude. The opening may be sized to allow the door-side hinge plate to rotate up to ninety degrees from the frame-side hinge plate at which point the door side-hinge plate may run up against a sidewall of the door stop. For example, such a door stop configuration may be employed to prevent an inward-opening door from hitting a wall that is located behind the door and oriented perpendicular to the frame.

Figure 6:
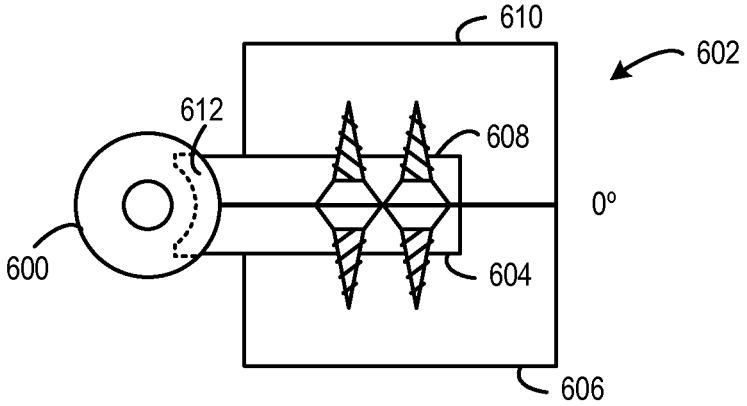
FIG. 6 shows a top view of a door stop configured with a designated range of radial hinge plate travel of zero degrees.

FIG. 6 shows a top view of a door stop 600 configured with a designated range of radial hinge plate travel of zero degrees. The door stop 600 may be installed on a door hinge assembly 602 that includes a frame-side hinge plate 604 that is mounted to a frame 606 and a door-side hinge plate 608 that is mounted to a door 610. The door stop 600 may form an opening 612 through which the hinge plates protrude. The opening may be sized to allow the door-side hinge plate to rotate zero degrees from the frame-side hinge plate. In other words, the door stop may be configured to prevent the door-side hinge plate from rotating away from the frame-side hinge plate. For example, such a door stop configuration may be employed to prevent a door from being opened in order to provide added security. In one example, the door stop may be installed on the door hinge assembly temporarily (e.g., at night while sleeping) to prevent the door from being opened. Such a door stop configuration may be particularly beneficial for hotel rooms or other applications where privacy and security are desired.

It will be understood that the door stop may be configured to allow for any suitable designated range of radial hinge plate travel without departing from the scope of the present disclosure. In another example, a door stop may be configured with a designated range of radial hinge plate travel of ninety degrees. In particular, an opening formed by the door stop may be sized to allow a door-side hinge plate to rotate up to ninety degrees from a frame-side hinge plate at which point the door side-hinge plate may run up against a sidewall of the door stop. For example, such a door stop configuration may be employed to prevent an inward-opening door from hitting a wall that is located behind the door and oriented perpendicular to the frame.

Figure 7:
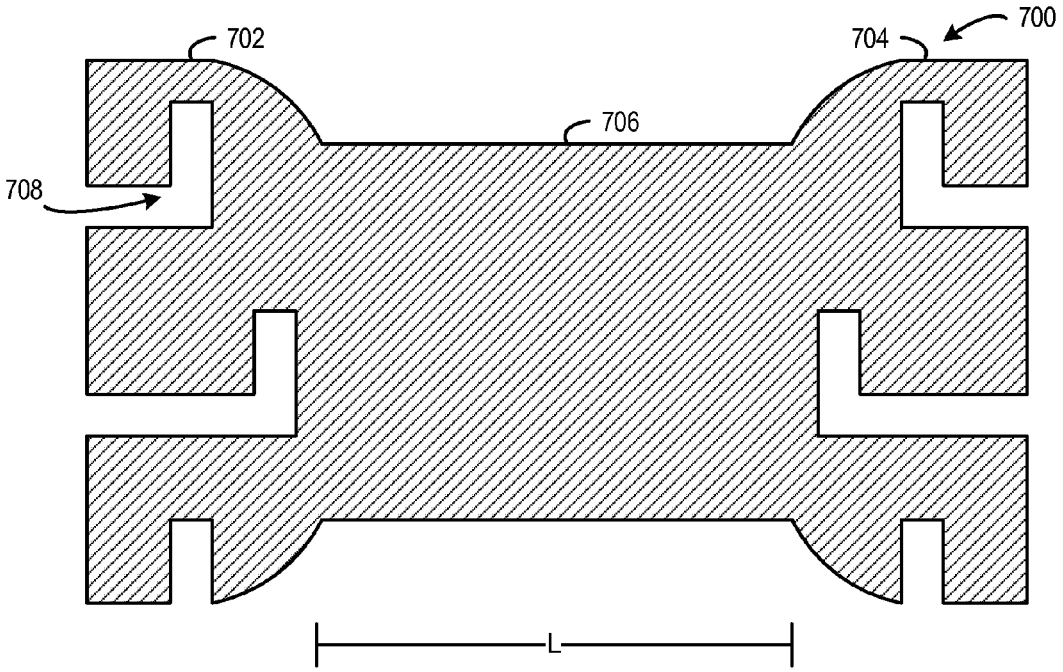
FIG. 7 shows another example of a door stop configured with a fixed range of radial hinge plate travel.

FIG. 7 shows another example of a door stop 700. The door stop 700 may be wrapped around hinge plates of a door hinge assembly to restrict travel of the hinge plates to a fixed range of angular rotation. The door stop 700 may be secured to the hinge plates by mounting screws that are fed through screw holes in the mounting plates to attach the door hinge assembly to the door and frame. In other words, the door stop may be compressed between the hinge plate assembly and the door/frame. The door stop 700 may be a substantially flat sheet or strap that is flexible. The door stop 700 includes a door-side portion 702, a frame-side portion 704, and a middle portion 706.

The door-side portion and the frame-side portion may have rounded edges that may be hidden by the hinge plates when installed on the door hinge assembly. Although it is to be understood that the side portions may have any shape of edge, such as squared or partially rounded. The door-side portion and the frame-side portion each may include a plurality of cutouts 708. The plurality of cutouts may be positioned to align with screw holes in the mounting plates of the hinge assembly. A width of each cutout may be large enough to accept a mounting screw shaft and narrow enough that a mounting screw head does not fit through the cutout. Each of the cutouts provides a path from an edge of the door stop to an alignment position. In this way, the door stop may be attached to the door hinge assembly without completely removing the mounting screws from the hinge plates.

In some embodiments, the cutouts may be replaced with holes or slats that align with the screw holes in the mounting plates. Further, in some embodiments, such holes may be reinforced, such as with grommets or the like.

The middle portion 706 may have a length (L) that determines the fixed designated range of angular rotation of the hinge plates. For example, an eighth of an inch may correspond to five degrees of angular rotation. As such, a door stop that restricts the angular rotation of the hinge plates to a designated range of up to ninety degrees of rotation may have a middle portion that has a length of two and half inches. It is to be understood that the length is merely one example, and the middle portion may be any suitable length to provide any suitable range of angular rotation of the hinge plates.

The door stop 700 may be made from any suitable material having a high strength-to-weight ratio and relative flexibility characteristics. Non-limiting examples of such material may include aramids, para-aramids, meta-aramids, nylon, ultra-high molecular weight polyethylene and other synthetic or natural fibers. Furthermore, the door stop 700 may be any suitable color. For example, the door stop 700 may be colored to match a finish of a door hinge assembly on which the door stop is to be installed. In another example, the door stop may have a clear matte finish that may easily blend in with colors of surrounding materials. Furthermore, the door stop may be sized to be installed on any suitable size door hinge assembly having any suitable number of mounting screws. Non-limiting examples of door hinge assembly sizes on which the door stop may be configured to be installed include three inch, three and a half inch, four inch, and four and a half inch. Moreover, the door hinge assembly may include hinge plates having any type of edges including squared, partially rounded, and rounded. Since the door stop may have side portions with rounded edges the side portion may be hidden by any of these types of hinge plates.

Figure 8:
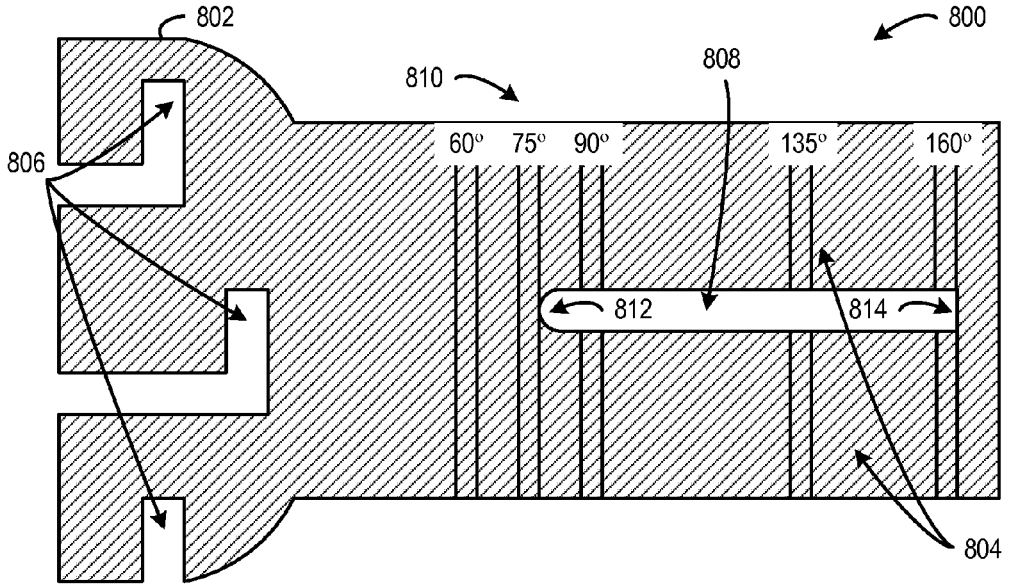
FIG. 8 shows another example of a door stop configured with an adjustable range of radial hinge plate travel.

FIG. 8 shows another example of a door stop 800. The door stop 800 may be wrapped around hinge plates of a door hinge assembly to restrict travel of the hinge plates to an adjustable range of angular rotation. In other words, the door stop 800 may be secured to the door hinge assembly in different positions to provide different fixed ranges of angular rotation. In the illustrated example, the door stop may be adjusted to various ranges between allowing a full range of angular rotation of sixty degrees and allowing a full range of angular rotation of one hundred and sixty degrees. The door stop 800 may be secured to the hinge plates by mounting screws that are fed through screw holes in the mounting plates to attach the door hinge assembly to the door and frame. The door stop 800 may be a substantially flat sheet or strap that is flexible.

The door stop 800 includes a side portion 802. The side portion 802 may be aligned with either a door-side hinge plate or a frame-side plate without departing from the scope of the present disclosure. The side portion 802 may have rounded edges that may be hidden by the hinge plate when installed on the door hinge assembly. Although it is to be understood that the side portion may have any shape of edge, such as squared or partially rounded.

The side portion 802 may include a plurality of cutouts 806 positioned to align with screw holes in the mounting plate of the hinge assembly. A width of each cutout may be large enough to accept a mounting screw shaft. Each of the cutouts provides a path from an edge of the door stop to an alignment position, such that the path may be open. In this way, the door stop may be attached to the door hinge assembly without completely removing the mounting screws from the hinge plates. In some cases, the path from the edge of the door stop to the alignment position may include a corner (e.g., a right angle) that forms a sidewall that may inhibit a screw from slipping out of the alignment position.

In some embodiments, the plurality of cutouts 806 may be replaced with holes or slats that align with the screw holes in the hinge plate. Further, in some embodiments, such holes may be reinforced, such as with grommets or the like.

The door stop 800 further includes a plurality of fingers 804 and a slat 808 formed between two of the fingers. In some cases, the plurality of fingers and the slat may be included in a restrictor portion of the door stop that may be configured to interact with a hinge plate to restrict a range of radial motion between a first hinge plate and a second hinge plate of a door hinge assembly on which the door stop is installed to a designated range of radial motion. The slat is an opening through the door stop formed between the fingers. The slat 808 may be positioned to align with a screw hole in a hinge plate that opposes the hinge plate that aligns with the side portion 802. A left edge 812 of the slat 808 may be curved or rounded to provide added strength in that area of the door stop to inhibit splitting or cracking of material between the fingers when the door stop 800 is folded around a door hinge. A right edge of the slat 808 may be formed by a connector portion 814 that connects the plurality of fingers 804 together. The plurality of fingers 804 may be connected by the connector portion 814 to maintain alignment between the fingers when the door stop is installed on a door hinge. Alternatively, in some implementations, the connector portion may be omitted such that the fingers do not connect to each other. In this example, the slat may be open-ended and may extend to an outer edge of the door stop. When the door stop 800 is installed onto the door hinge assembly, a mounting screw may be tightened down in different lateral positions in the slat 808 to adjust a range of angular rotation of the hinge plates. In the illustrated embodiment, the mounting screw may be tightened down on a right side of the slat to provide a larger range of angular rotation and the mounting screw may be tightened down on the left side of the slat to provide a smaller range of angular rotation. In some cases, the fingers may be sized to allow upper and lower mounting screws to be tightened down on the outer edges of the fingers to provide additional attachment strength.

A plurality of angle indicators 810 may be displayed on the plurality of fingers to indicate a mounting position that provides a corresponding range of angular rotation. In particular, the angle indicators may include vertical lines that may align with an edge of a hinge plate (or other designated position of the door hinge assembly) to provide the corresponding range of angular rotation.

It will be appreciated that the plurality of fingers may be any suitable length and may form any suitable number of slats to align with mounting screw holes of a hinge plate. The door stop 800 may be configured to adjust to any suitable range of angular rotation. In one example, the door stop may be adjustable anywhere between a range of zero to sixty degrees and a range of zero to one hundred and sixty degrees of angular rotation. Elements of the door stop 800 that may be substantially the same as those of door stop 700 are identified in the same way and are described no further. However, it will be noted that elements identified in the same way in different embodiments of the present disclosure may be at least partly different.

Figure 9:
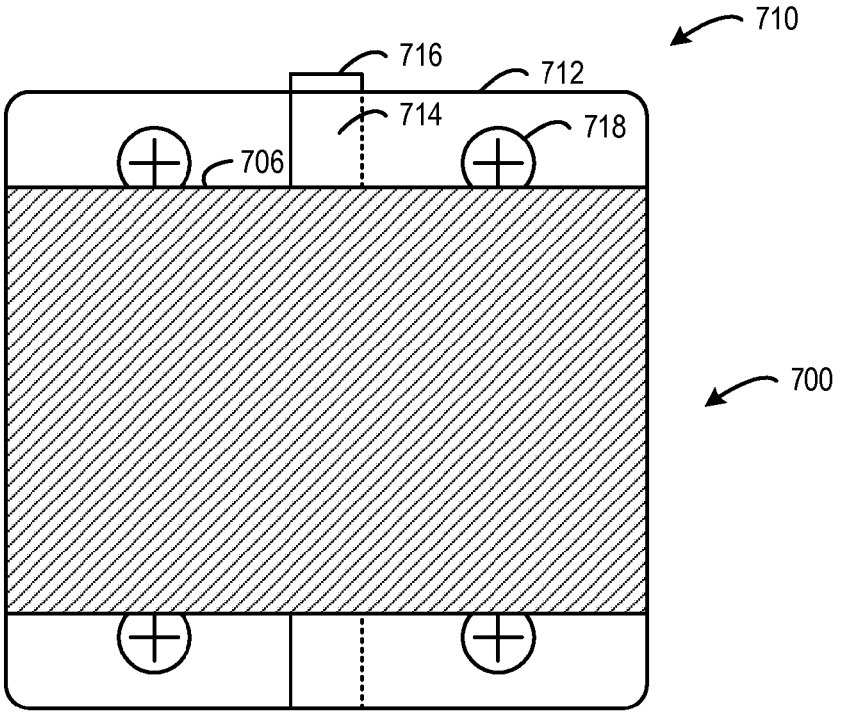
FIG. 9 shows a front view of the door stop of FIG. 7 installed on a door hinge assembly.

FIG. 9 shows a front view of the door stop 700 installed on a six-screw door hinge assembly 710. The door hinge assembly 710 may include hinge plates 712, knuckles 714, a hinge pin 716, and screw holes 718. The hinge plates may be mounted to a door and frame via screws that are fastened through the screw holes. The middle portion 706 of the door stop 700 may span across the hinge plates to control the angular range of travel. Since the door stop may be flexible, the middle portion of the door stop may curl or bend when the hinge plates rotate toward each other. In some implementations, the middle portion of the door stop may include a living hinge that forms a crease when the hinge plates rotate toward each other.

Figure 10:
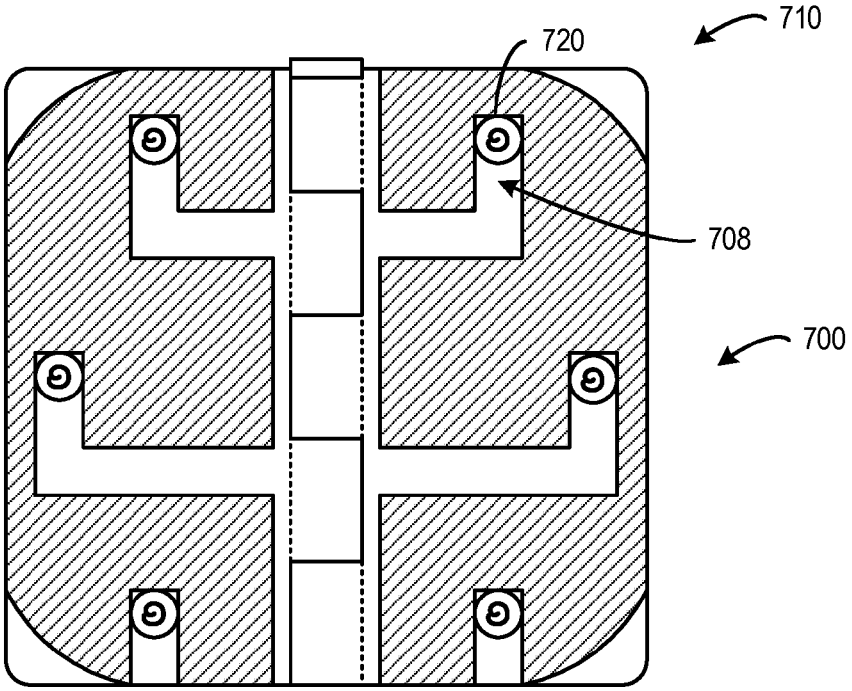
FIG. 10 shows a rear view of the door stop of FIG. 7 installed on a door hinge assembly.

FIG. 10 shows a rear view of the door stop 700 installed on the six-screw door hinge assembly 710. The door stop may be secured to the door hinge assembly by mounting screws 720. To install the door stop, the mounting screws may be loosened, and the door stop may be inserted around the mounting screws via the cutouts 708. When the door stop is in position, the mounting screws may be tightened down to secure the door stop to the door hinge assembly. In other words, the side portions may be compressed between the hinge plates and the door/frame via compression of the screws.

Figure 11:
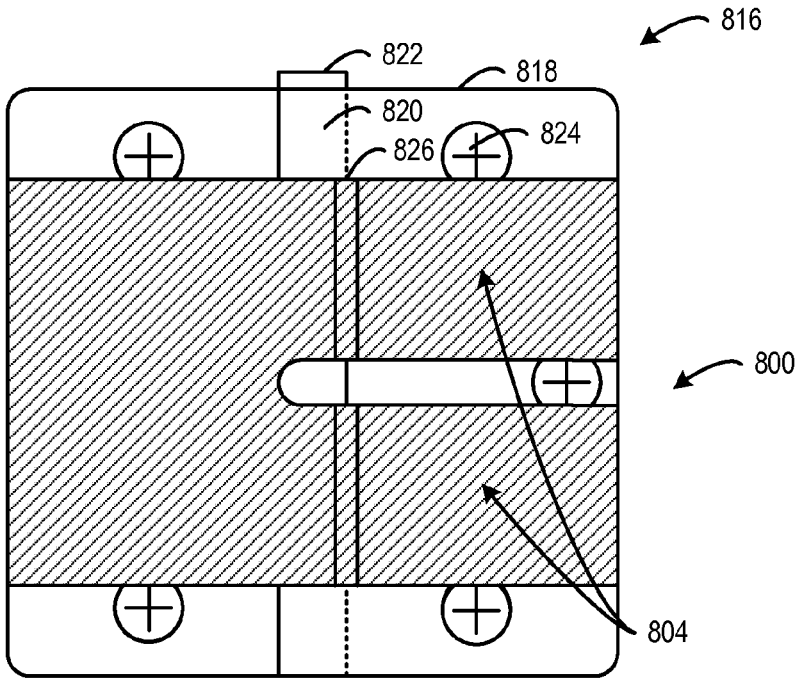
FIG. 11 shows a front view of the door stop of FIG. 8 installed on a door hinge assembly.

FIG. 11 shows a front view of the door stop 800 installed on a door hinge assembly 816. The door hinge assembly 816 may include hinge plates 818, knuckles 820, a hinge pin 822, and screw holes 824. The hinge plates may be mounted to a door and frame via screws that are fastened through the screw holes. The fingers 804 of the door stop 800 may span across the hinge plates to control the angular range of travel. The door stop 800 may be installed by aligning an angle indicator 826 with an edge of the hinge plate 818. Since the door stop may be flexible, the fingers of the door stop may curl or bend when the hinge plates rotate toward each other. In some cases, portions of the door stop may be rigid and connected by a thinned or cut crease portion to create a living hinge that bends or folds along that same crease when the door hinge moves radially. In some implementations, a different crease may be aligned with each angle indicator. In other words, the door stop may include a plurality of creases that can be used to form a living hinge depending on which range of angle rotation setting is selected.

Figure 12:
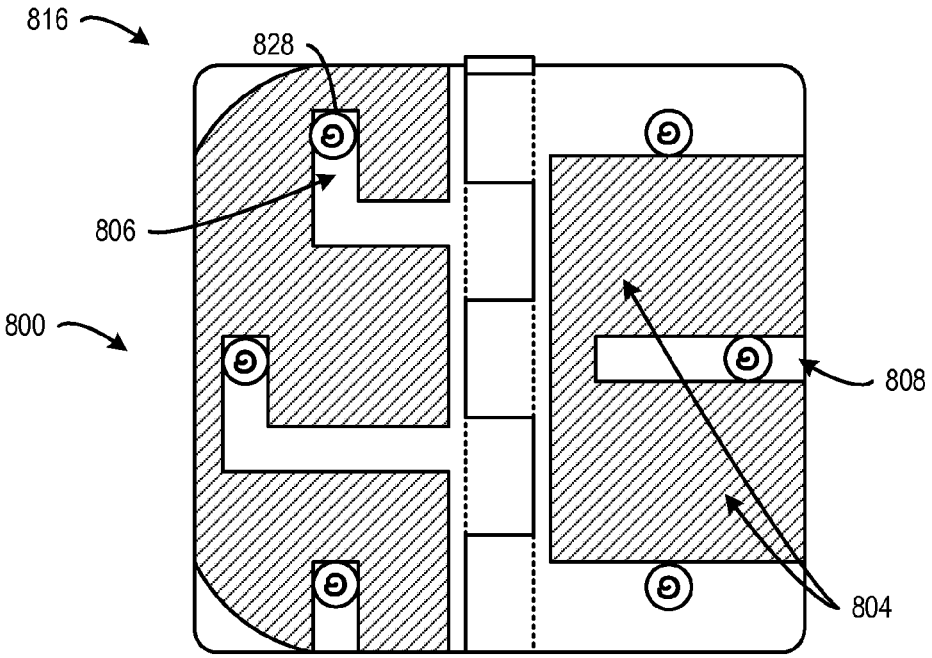
FIG. 12 shows a rear view of the door stop of FIG. 8 installed on a door hinge assembly.

FIG. 12 shows a rear view of the door stop 800 installed on the door hinge assembly 816. The door stop may be secured to the door hinge assembly by mounting screws 828. To install the side portion of the door stop, the mounting screws may be loosened on the hinge plate shown on the left side, and the door stop may be inserted around the mounting screws via the cutouts 806. On the other side, the middle mounting screw may be inserted into the slat 808 at an appropriate lateral position to achieve a desired range of angular rotation. For example, the middle screw may be tightened down at a position in the slat where a desired angle indicator of the door stop aligns with an edge of the hinge plate. Further, the fingers 804 may be positioned between the middle mounting screw and the outer mounting screws. When the door stop is in position, the mounting screws may be tightened down to secure the door stop between the door hinge assembly and the door/frame.

Figure 13:
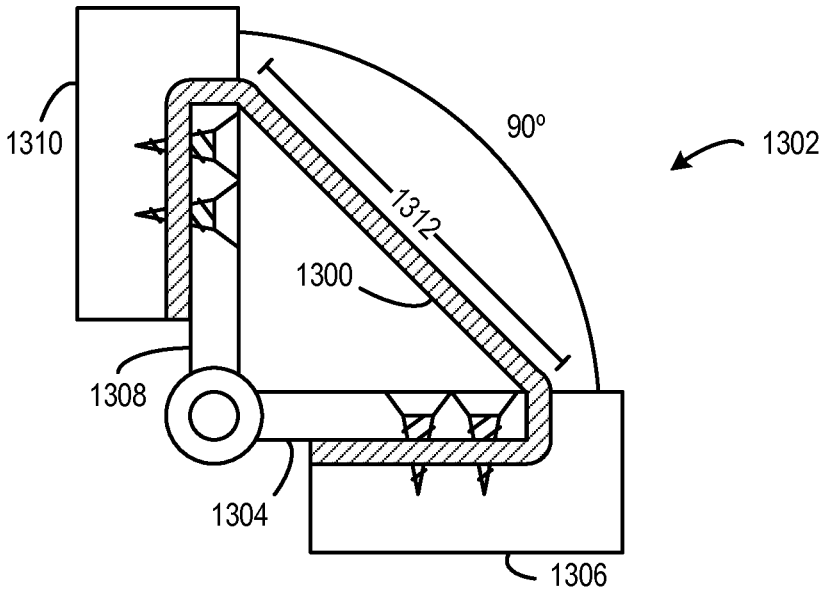
FIG. 13 shows a top view of an example door stop in a taut position that prevents the door hinge from traveling more than ninety degrees.

FIG. 13 shows a top view of a door stop 1300 in a taut position. The door stop 1300 may have a designated range of radial hinge plate travel up to ninety degrees. The door stop 1300 may be installed on a door hinge assembly 1302 that includes a frame-side hinge plate 1304 that is mounted to a frame 1306 and a door-side hinge plate 1308 that is mounted to a door 1310. A middle portion 1312 of the door stop 1300 may be pulled taut to restrict the hinge plates from rotating beyond ninety degrees.

Figure 14:
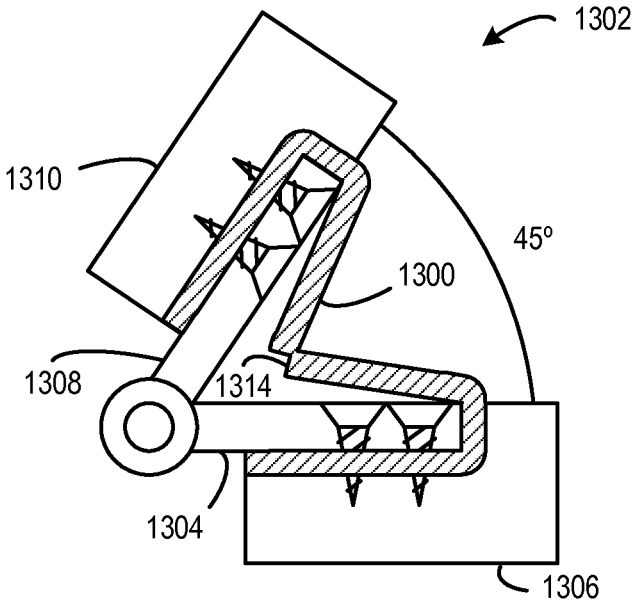
FIG. 14 shows the door stop of FIG. 13 in a slack position.

FIG. 14 shows a top view of the door stop 1300 in a slack position. The hinge plates are rotated forty five degrees, so that a distance between the two hinge plates is less than a length of the middle portion of the door stop 1300. Accordingly, the middle portion of the door stop bends in between the two hinge plates to allow the two hinge plates to come together. In some implementations, the door stop may include a living hinge 1314 that creates a crease when the middle portion of the door stop bends inward towards the hinge plates. In some cases, the living hinge may include a cut or thinned portion of the door stop that creates the crease. In some cases, the material of the door stop may be creased to create the living hinge. For example, when the door stop is installed on the door hinge assembly, the door may be closed for a period of time (e.g., fifteen minutes) to set the crease. Note that a thickness of the door stop is not drawn to scale. Further, the door stop may be thin enough so as not to obstruct the door from closing or otherwise interfere with functionality of the door. In one example, the door stop may have a thickness in a range of 0.015 to 0.025 inches. Moreover, the thin, sheet-like characteristics of the door stop may not interfere with mounting of the door hinge assembly to the door and frame. For example, such a door stop configuration may be employed to prevent an inward-opening door from hitting a wall that is located behind the door and oriented perpendicular to the frame.

Figure 15:
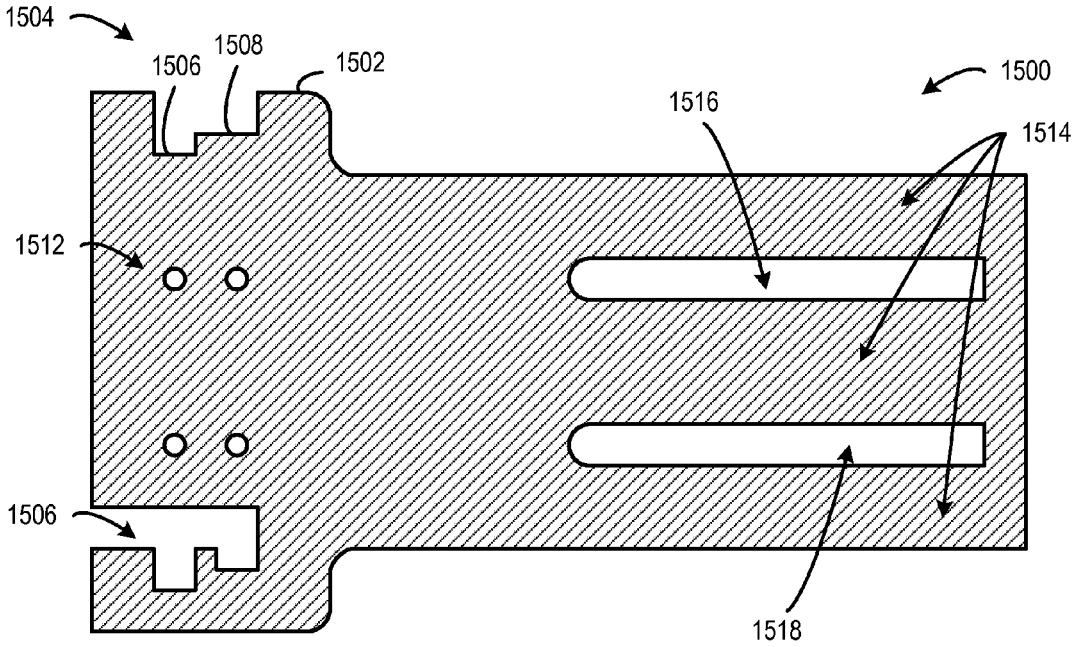
FIG. 15 shows another example of a door stop configured to be installed on a plurality of different types of door hinge assemblies.

FIG. 15 shows another example of a door stop 1500 that includes features that may allow the door stop to be installed on various different types of door hinges. For example, the door stop 1500 includes a side portion 1502 that forms a first cutout 1504 and a second cutout 1506. Each cutout forms a first alignment position 1508 and a second alignment position 1510. The different alignment positions may be used to secure the door stop to different types of hinge plates having screw holes in different positions. The side portion 1502 further includes a plurality of holes 1512 that may align with screw holes of different types of hinge plates.

The door stop 1500 further includes a plurality of fingers 1514 that form a first slat 1516 and a second slat 1518. The different slats may be positioned to align with screw holes of different types of door hinge plates. In some cases, screws may be positioned in both slats to secure the door stop to a door hinge. In other cases, a screw may be positioned in only one of the slats to secure the door stop to a door hinge. Further, the plurality of fingers may be sized to be positioned between middle screws and outer screws of a hinge plate, such that the outer screws may be tightened down to secure an outer edge of a finger to the hinge plate.

It will be understood that the door stop may include any suitable features that allow for the door stop to be installed on different types of door hinges. For example, such features may allow the door stop 1500 to be installed on door hinges having an S screw-hole configuration, a D screw-hole configuration, or another suitable screw-hole configuration.

Figure 16:
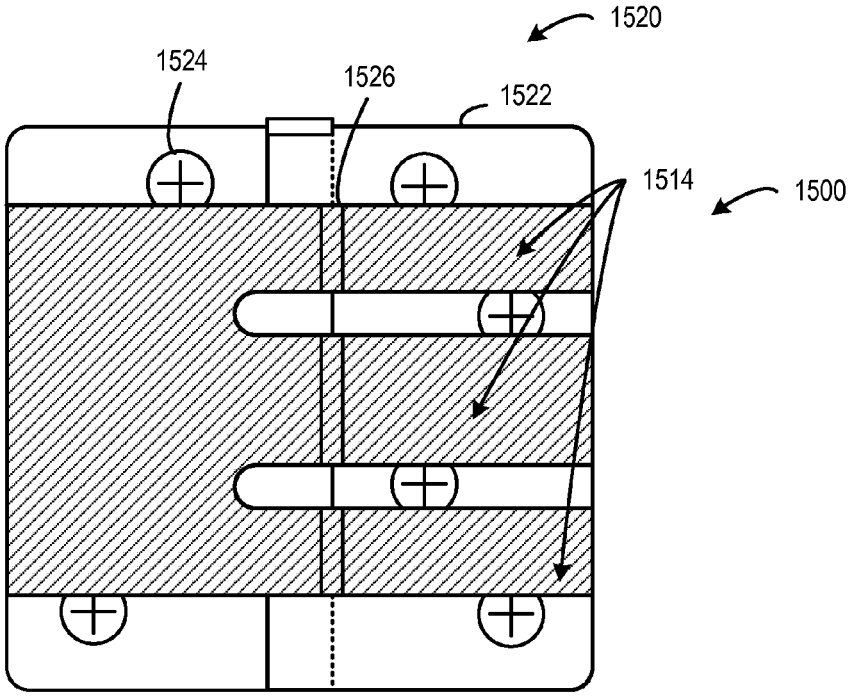
FIG. 16 shows a front view of the door stop of FIG. 15 installed on a door hinge assembly.

FIG. 16 shows a front view of the door stop 1500 installed on a door hinge assembly 1520 having an S screw-hole configuration. The door hinge assembly 1520 may include hinge plates 1522 that form screw holes 1524. The hinge plates may be mounted to a door and frame via screws that are fastened through the screw holes. The fingers 1514 of the door stop 1500 may span across the hinge plates to restrict the radial motion of the hinge plates. The door stop 1500 may be installed by aligning an angle indicator 1526 with an edge of the hinge plate 1522.

Figure 17:
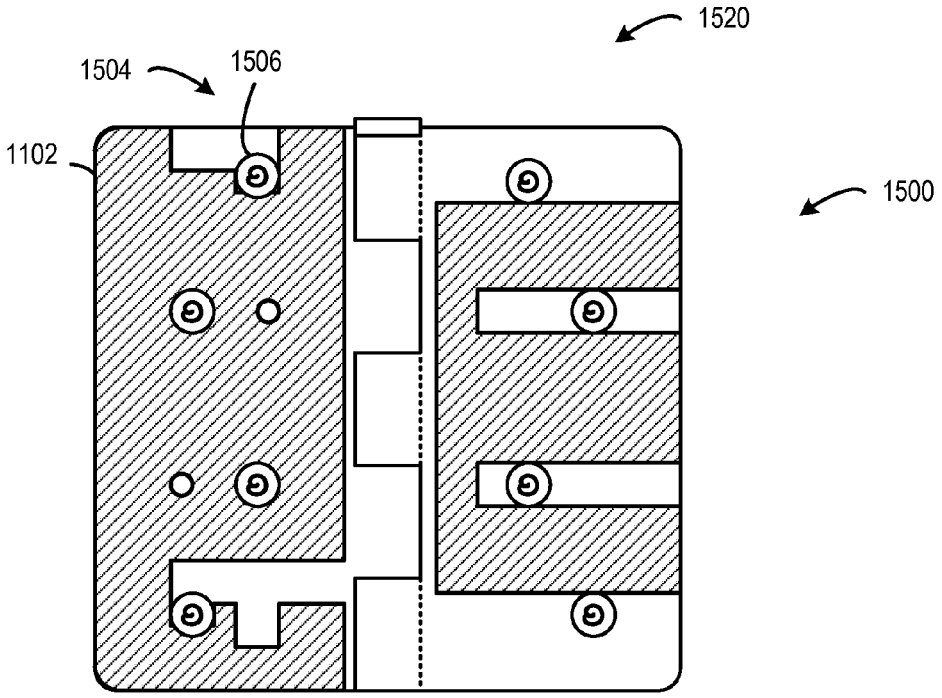
FIG. 17 shows a rear view of the door stop of FIG. 15 installed on a door hinge assembly.

FIG. 17 shows a rear view of the door stop 1500 installed on the door hinge assembly 1520. The door stop may be installed by being compressed between the hinge plate assembly and the door/frame via compression from the screws. In particular, to install the side portion 1502 of the door stop 1500, mounting screws may be secured into a corresponding alignment position of each cutout (e.g., alignment position 1506 of cutout 1504). Further, mounting screws may be inserted into corresponding screw holes in the side portion. On the other side, mounting screws may be inserted into the two slats at appropriate lateral positions to achieve a desired range of angular rotation. For example, the middle screws may be tightened down at positions in the slats where a desired angle indicator of the door stop aligns with an edge of a hinge plate or another suitable location. Further, the plurality of fingers may be positioned between the middle mounting screws and the outer mounting screws. When the door stop is in position, the mounting screws may be tightened down to secure the door stop to the door hinge assembly.

Figure 18:
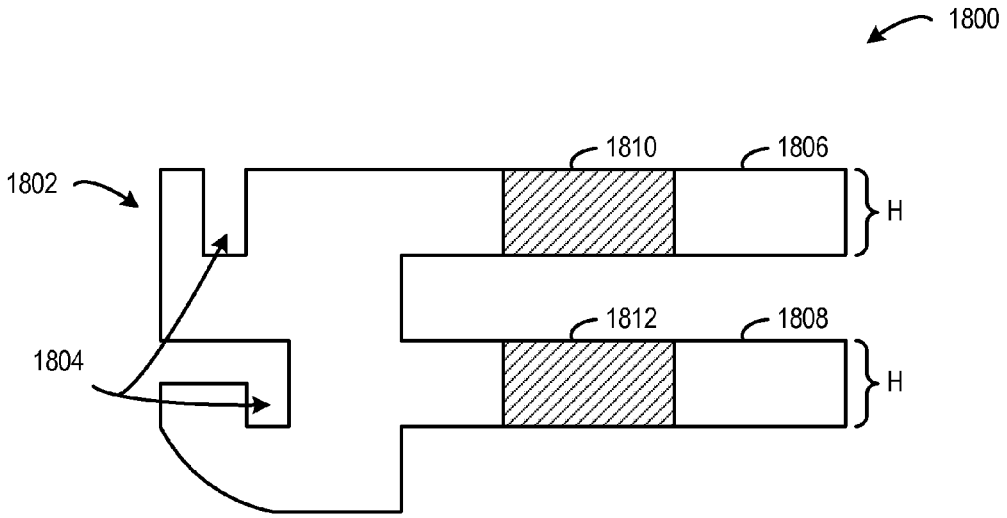
FIG. 18 shows another example of a door stop configured to temporarily hold a door at a designated position.

FIG. 18 shows another example of a door stop 1800. The door stop may be configured to temporarily hold a door at a designated position that may be variably adjustable to any suitable opening position through manipulation of a pull strap of the door stop. The door stop may be a substantially flat sheet or strap that is flexible. The door stop may be made from any suitable material or combination of materials. In some embodiments, the door stop may be flexible and stretchable to facilitate mating with a door hinge assembly, as well as to facilitate operation of the pull strap.

The door stop may include a side portion 182 including a plurality of cutouts 1804. The cutouts may be configured to align with screw holes of a hinge plate of the door hinge assembly in order to mount the door stop to the door hinge assembly. The side portion may be configured to align with either a door-side hinge plate or a frame-side hinge plate of the door hinge assembly.

A first pull strap 1806 and a second pull strap 1808 may extend away from the side portion. In some cases, the first and second pull straps may be included in a restrictor portion of the door stop configured to interact with a hinge plate to restrict a range of radial motion between a first hinge plate and a second hinge plate of a door hinge assembly on which the door stop is installed to a designated range of radial motion. Each of the pull straps may be configured to fit through a space formed between a hinge plate and a knuckle of the door hinge assembly. In particular, the pull straps may have a height (H) that substantially corresponds to a height of the space formed between the knuckle and the hinge plate of the door hinge assembly. Although the pull straps may be any suitable height, length, etc.

The first pull strap may include a first engagement section 1810 and the second pull strap may include a second engagement section 1812. The engagement sections may be configured to grip or otherwise engage the hinge plate and/or the knuckle when the pull strap is pulled taught through the space formed between the knuckle and the hinge plate in order to maintain the hinge plate at a fixed position. In other words, a door may be placed at a desired position and the pull strap may be pulled taught to maintain the door at that position. On the other hand, when the pull strap is pushed back through the space, the engagement section may be disengaged and the hinge plate may swing freely.

The engagement section may include a high-friction material that interacts with the hinge plate and/or the knuckle to hold the hinge plate in place. The high-friction material of the engagement section may include any suitable material. In one example, the high-friction material may include a plurality of hooks or finger members that increase the contact surface area between the hinge plate and/or the knuckle and the engagement section of the pull strap. Moreover, the finger members may provide a counter force on both sides of the hinge plate that inhibits the hinge plate from swinging.

In some embodiments, the high-friction material may be disposed on one side of the pull strap. In some embodiments, the high-friction material may be disposed on both sides of the pull strap. In some embodiments, the thickness of the engagement section may be greater than other sections of the pull strap. In some embodiments, the pull strap may include a grip material or structure, such as a loop or handle that may aid in operating the pull strap.

The door stop may include two pull straps to accommodate mounting to either hinge plate of the door hinge assembly, while having at least one pull strap aligning with a space formed between a knuckle and a hinge plate. In some embodiments, the door stop may include a single pull strap. It is to be understood that the pull strap may engage the hinge plate and/or the knuckle in any suitable manner to maintain the hinge plate fixed at a desired position.

Figure 19:
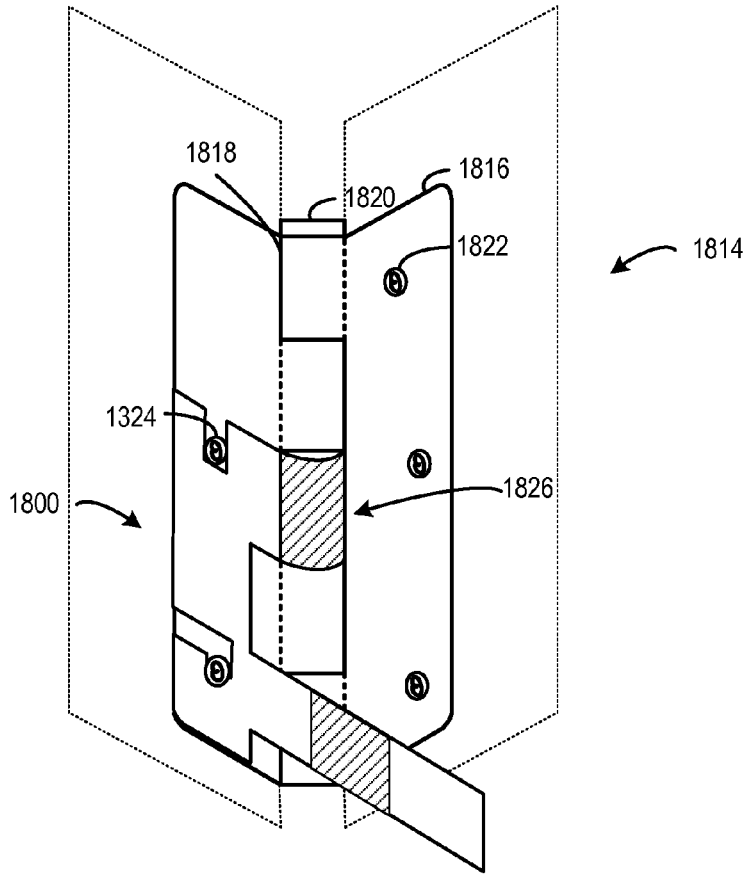
FIG. 19 shows a rear view of the door stop of FIG. 18 installed on a door hinge assembly.

FIG. 19 shows a rear view of the door stop 1800 installed on a door hinge assembly 1814. The door hinge assembly 1814 may include hinge plates 1816, knuckles 1818, a hinge pin 1820, and screw holes 1822. The hinge plates may be mounted to a door and frame via screws 1824 that are fastened through the screw holes. The side portion of the door stop may be aligned with the hinge plate such that the cutouts are aligned with the screw holes. When the door stop is installed onto the door hinge assembly, the mounting screws may be tightened down through the screw holes to fix the door stop in position. The first pull strap may be inserted through a space 1826 formed between a middle knuckle and the opposing hinge plate. In the illustrated example, the first pull strap is pulled taught such that the engagement portion is engaged with the hinge plate to fix the hinge plate at that designated radial position. The second pull strap may not be engaged and may be hidden from view behind the door hinge assembly. In some cases, the second pull strap may be removed (e.g., cutoff) when it is determined which pull strap fits with the door hinge assembly on which the door stop is installed.

Figure 20:
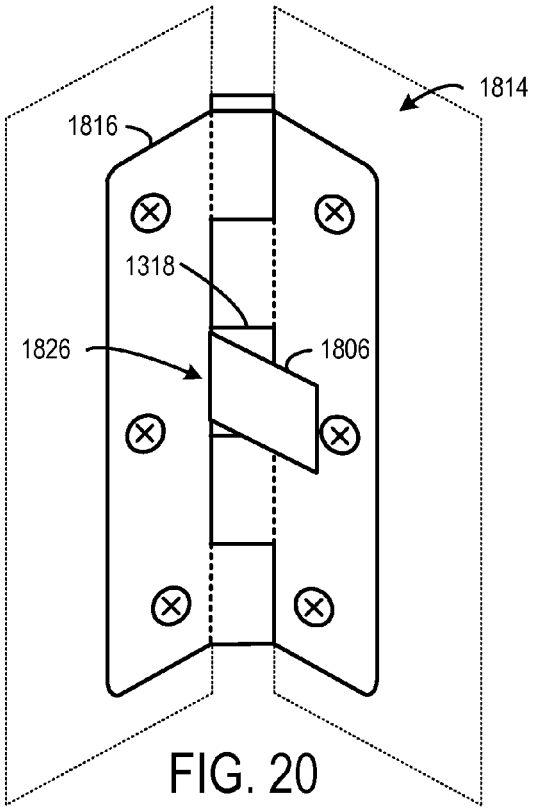
FIG. 20 shows a front view of the door stop of FIG. 18 installed on a door hinge assembly in a disengaged state.

FIG. 20 shows a front view of the door stop 1800 installed on the door hinge assembly 1814 in a disengaged state. The first pull strap 1806 protrudes through the space 1826 between the knuckle and the hinge plate. The first pull strap is not pulled taught and the engagement section is not engaged with the hinge plates, so the hinge plates are allowed to swing freely.

Figure 21:
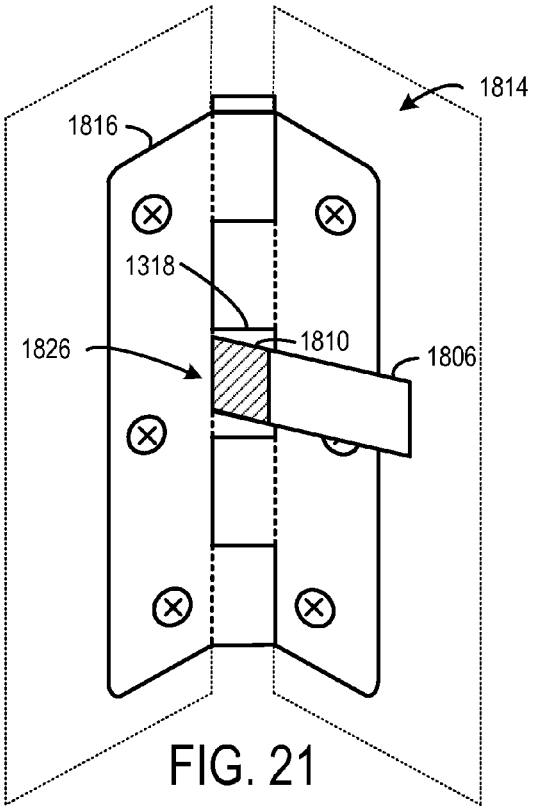
FIG. 21 shows a front view of the door stop of FIG. 18 installed on a door hinge assembly in an engaged state.

FIG. 21 shows a front view of the door stop 1800 installed on the door hinge assembly 1814 in an engaged state. The first pull strap 1806 protrudes through the space 1326 between the knuckle 1318 and the hinge plate 1316. The first pull strap 1306 is pulled taught and the engagement section 1810 is engaged with the hinge plate, so the hinge plate is fixed in position and not allowed to swing freely. Note that even when pulled taught, the pull strap may not extend past the edge of the hinge plate. In other words, the pull strap may have a low profile that is less likely to be noticed relative to other door stop configurations.

Figure 22:
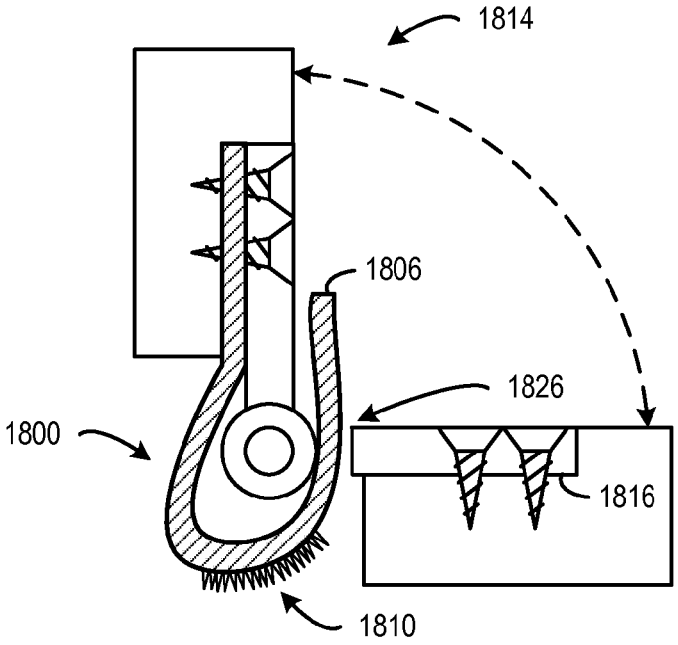
FIG. 22 shows a top view of the door stop of FIG. 18 installed on a door hinge assembly in a disengaged state.

FIG. 22 shows a top view of the door stop 1800 installed on the door hinge assembly 1814 in the disengaged state. When the first pull strap 1806 is not pulled taught, the engagement section 1810 may be pushed away from the space 1826 in the door hinge assembly allowing the hinge plates 1816 to swing freely. Note that a portion of the pull strap that extends beyond the engagement section may not interfere with operation of the door hinge assembly, so that portion of the pull strap may remain in the space when the door stop is disengaged.

Figure 23:
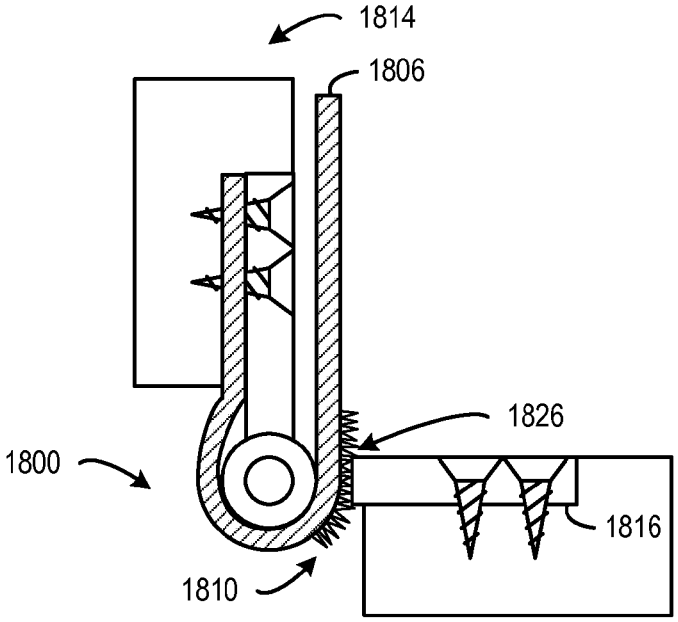
FIG. 23 shows a top view of the door stop of FIG. 18 installed on a door hinge assembly in an engaged state.

FIG. 23 shows a top view of the door stop 1800 installed on the door hinge assembly 1814 in an engaged state. When the first pull strap 1806 is pulled taught, the engagement section 1810 may pass through the space 1826 in the door hinge assembly and engage the hinge plate 1816 (and/or the knuckle of the opposing hinge plate). In particular, the finger members of the engagement section may provide enough friction through surface area contact to fix the hinge plate at a desired position. The hinge plate may remain in the fixed position until the pull strap is pushed back through the space to disengage the engagement section of the pull strap from the space.

The above described door stop may provide a low profile and non-intrusive solution to fixing a door at a desired position that may be variably adjustable through minimal manipulation of a pull strap.

It is to be understood that views of the illustrated embodiments are generally not drawn to scale; aspect ratios, feature size, and numbers of features may be purposely distorted to make selected features or relationships easier to see.

The embodiments disclosed herein are presented in view of the present invention. Other embodiments, forms, modes and applications are achievable while remaining within the scope of the description. Finally, it will be understood that the articles described herein are exemplary in nature, and that these specific embodiments or examples are not to be considered in a limiting sense, because numerous variations are contemplated. Accordingly, the present disclosure includes all novel and non-obvious combinations and sub-combinations of the various articles and methods disclosed herein, as well as any and all equivalents thereof.

The invention claimed is:

1. A door system, comprising:

a door;

a hinge assembly, including:

a door-side hinge plate secured to the door via a door-side screw, the door-side hinge plate including first knuckles and a door-side edge distal the first knuckles, a frame-side hinge plate configured to be secured to a door frame via a frame-side screw, the frame-side hinge plate including second knuckles and a frame-side edge distal the second knuckles, and a hinge pin inserted through the first knuckles and the second knuckles; and a flat, flexible sheet including:

a side mounting portion including a frame-side terminal end wrapped around the frame-side edge of the frame-side hinge plate and secured to the frame-side hinge plate, configured to be adjacent the door frame, the side mounting portion defining a cutout through which the frame-side screw extends into the door frame, and a restrictor portion including a door-side terminal end wrapped around the door-side edge of the door-side hinge plate and secured between the door-side hinge plate and the door, the restrictor portion including a top finger extending from the side mounting portion and a bottom finger extending from the side mounting portion, the top finger and the bottom finger defining an elongate slat offering a range of different door-side screw positions for adjusting a range of angular rotation between the door-side hinge plate and the frame-side hinge plate.

2. The door system of claim 1, wherein the flat, flexible sheet further includes a connector portion defining a far edge of the elongate slat between the top finger and the bottom finger.

3. The door system of claim 1, further comprising the door frame.

4. The door system of claim 1, wherein the flat, flexible sheet folds between the door-side hinge plate and the frame-side hinge plate responsive to the door closing.

5. The door system of claim 1, wherein the flat, flexible sheet extends in a straight line between the door-side hinge plate and the frame-side hinge plate responsive to the door opening.

6. The door system of claim 3, wherein the flat, flexible sheet folds between the door-side hinge plate and the frame-side hinge plate responsive to the door closing.

7. The door system of claim 3, wherein the flat, flexible sheet extends in a straight line between the door-side hinge plate and the frame-side hinge plate responsive to the door opening.

8. The door system of claim 3, wherein the flat, flexible sheet further includes a connector portion defining a far edge of the elongate slat between the top finger and the bottom finger.

* * * * *